US006478299B2

(12) United States Patent
Bialler et al.

(10) Patent No.: US 6,478,299 B2
(45) Date of Patent: Nov. 12, 2002

(54) MAGNETIC TABLE TOP GAME

(76) Inventors: Valeri Villievich Bialler, 93 Katerina Avenue, Thornhill, Ontario (CA), L4J 8H4; Mikhail Arkadievich Rodionov, 499 Hounslow Avenue, Toronto, Ontario (CA), M2R 1J1; Michael Semion Elent, 8 Brownridge, Thornhill, Ontario (CA), L4J 7X6; Felix Semion Elent, 91 Townsgate Drive, PH 204, Thornhill, Ontario (CA), L4J 8E8; Fred Gordon Bates, 74 Westchester Drive, Oakville, Ontario (CA), L6H 6H8; Richard Peter Fast, P.O. Box 60059, Oakville, Ontario (CA), L6M 2S0

( * ) Notice: Subject to any disclaimer, the term of this patent is extended or adjusted under 35 U.S.C. 154(b) by 0 days.

(21) Appl. No.: 09/818,853

(22) Filed: Mar. 28, 2001

(65) Prior Publication Data

US 2002/0140167 A1 Oct. 3, 2002

Related U.S. Application Data

(63) Continuation-in-part of application No. 09/716,125, filed on Nov. 9, 2000.

(30) Foreign Application Priority Data

Jan. 5, 2000 (CA) ..... 2293914

(51) Int. Cl.[7] ..... A63F 7/06

(52) U.S. Cl. ..... 273/108.1; 273/108.51; 273/126 A; 273/119 A

(58) Field of Search ..... 273/108.1, 108.51, 273/126 A, 119 A, 126 R, 119 R, 108.5, 108.55, 108.56

(56) References Cited

U.S. PATENT DOCUMENTS

| | | | | |
|---|---|---|---|---|
| 2,263,115 A | | 11/1941 | Winter | |
| 2,716,028 A | | 8/1955 | Yaeger | |
| 3,091,459 A | | 5/1963 | Lindman | |
| 3,782,726 A | | 1/1974 | Huffman et al. | |
| 3,823,941 A | | 7/1974 | Ochi et al. | |
| 3,976,296 A | * | 8/1976 | Smith | 273/108.1 |
| 4,012,040 A | | 3/1977 | Fernandes | |
| 4,192,508 A | * | 3/1980 | Livick | 273/118 A |
| 4,834,371 A | | 5/1989 | Hay et al. | |
| 5,016,878 A | * | 5/1991 | Hay et al. | 273/108.51 |
| 5,275,401 A | * | 1/1994 | Llorens | 273/108.51 |
| 6,189,885 B1 | * | 2/2001 | Hamot | 273/108.1 |

FOREIGN PATENT DOCUMENTS

| | | | |
|---|---|---|---|
| DE | 2609458 | * | 9/1977 |
| DE | 3046136 | * | 7/1982 |
| FR | 2668713 | * | 5/1992 |

* cited by examiner

*Primary Examiner*—Raleigh W. Chiu
(74) *Attorney, Agent, or Firm*—Elias Borges

(57) ABSTRACT

A device for movably coupling a gaming piece to a substantially non-magnetic surface having opposite first and second sides is disclosed. The device comprises a base which is mounted to the gaming piece, the base comprising a housing, a first and second magnet and a first support element positioned between the first and second magnets. The first support element is dimensioned and. configured to support the base on the first side of the surface. The device has a magnetic coupling positioned on the second side of the surface, said magnetic coupling comprising a spindle member having an axis of rotation and a first and second magnet, the spindle member being rotatably mounted in a carriage housing. The carriage housing is adapted and configured to position the magnets of the spindle in close proximity to the opposite side of the surface without making contact with said surface, the base housing, support member and the carriage housing configured to position the magnets of the base in close proximity to the magnets of the magnetic coupling when the base and magnetic coupling are positioned across each other on opposite sides of the surface. The device also having an elongated rod having an axis and opposite first and second ends, a first end rotatably mounted to the carriage, the second end of the elongated rod adapted to be grasped by a user, the first end of the elongated rod coupled to the spindle such that rotating the elongated rod causes a corresponding rotation of the spindle.

18 Claims, 9 Drawing Sheets

MAGNETIC TABLE TOP GAME

CROSS-REFERENCE TO RELATED APPLICATIONS

This application is a continuation-in-part of application Ser. No. 09/716,125 filed Nov. 9, 2000 and entitled "Magnetic Table Top Game", hereby incorporated by reference.

FIELD OF THE INVENTION

The invention relates generally to magnetic games and in particular to magnetic table top or magnetic stand alone sports games.

BACKGROUND OF THE INVENTION

Table top games, such as table top hockey games, have been know for some time. These table top games generally consist of a playing board shaped to resemble a hockey arena or the like and several mechanically operated gaming pieces which are movably attached to the playing board. The gaming pieces are generally controlled by long lever arms which are coupled to the gaming pieces by a gear mechanism positioned beneath the gaming board. A player may move the gaming piece along the board by pulling or pushing the lever arm. The player may also rotate the gaming piece by twisting the lever arm. The gaming pieces are generally mounted to the gaming board along elongated slots, which help guide the playing pieces along the board, and at the same time, permit a mechanical connection between the gear mechanism and the gaming piece. Rotating the gaming piece is an important aspect of the game since it permits the player to manipulate the gaming piece to permit the piece to shoot the ball, puck or similar object.

Traditional table top games are very popular, however, the elongated slots associated with these traditional games are a nuisance. Firstly, the addition of elongated slots does not permit the use of forced air levitation of the puck. Furthermore, the mechanical connection between the gearing mechanism and the player piece through the slot makes it difficult to remove gaming pieces to simulate penalty situations. While gaming pieces in such slot-type games can be removed forcibly by hand, it requires the game play to be suspended while the game is partially disassemble. Finally, the elongated slots detract from the realism of the game play. Therefore, attempts have been made to provide gaming boards having magnetically controlled playing pieces. Existing magnetic table games utilize magnetic control systems consisting of magnetic gaming pieces which are manipulated by magnetic lever arms. The lever arms are provided with a magnet at one end which are used to magnetically couple the magnetic playing piece located on the opposite side of the playing surface. The magnets used in this system must be sufficiently strong to keep the gaming pieces on the playing surface. As the user pulls or pushes the lever arm, the magnetic playing piece is dragged across the playing surface. Unfortunately, prior magnetically operated table top games do not provide an optimum balance between the magnetic forces keeping the playing pieces on the playing surface and the force required by the user to manipulate the lever arm. If the magnetic forces are increased to ensure the playing pieces are securely held on the playing surface, then it will be very difficult to move the pieces because of the increased friction between the playing piece or lever arm and the playing surface. Furthermore, if the magnetic forces are high, then it will be very difficult for small children to use the game because they will not have the strength to move the gaming pieces. If the magnetic forces are decreased, then it will be difficult to accurately control the pieces.

Another problem with existing table top games, particularly top hockey games, is the limited reach of the game pieces. Game pieces on traditional tabletop games are controlled by long rigid lever arms which extend under the playing surface. Since these lever arms must translate a torsional force to the gaming piece at the end of the lever arm, they could only move the players in a straight line across the board. This characteristic of traditional table top hockey games made it difficult for these games to mimic many of the actions of real players. In particular, it has been very difficult to create a table top hockey game where player pieces can be maneuvered behind the opposing sides goal and still be manipulated adequately by a player. There is a need for a table top magnetic board game which has a system of player manipulation which is versatile enough to maneuver player pieces so as to mimic a variety of realistic scenarios such as skating out from behind an opponents goal post. There also remains a need for a table top magnetic board game which is easy to play, economical to construct and which more accurately mimics the actions of real players.

SUMMARY OF THE INVENTION

The present invention is a device for movably coupling a gaming piece to a substantially non-magnetic surface having opposite first and second sides. The device comprises a base which is mounted to the gaming piece, the base comprising a housing, a first and second magnet and a first support element positioned between the first and second magnets. The first support element is dimensioned and configured to support the base on the first side of the surface. The device has a magnetic coupling positioned on the second side of the surface, said magnetic coupling comprising a spindle member having an axis of rotation and a first and second magnet, the spindle member being rotatably mounted in a carriage housing. The carriage housing is adapted and configured to position the magnets of the spindle in close proximity to the opposite side of the surface without making contact with said surface, the base housing support member and the carriage housing configure to position the magnets of the base in close proximity to the magnets of the magnetic coupling when the base and magnetic coupling are positioned across each other on opposite sides of the surface the device also having an elongated rod having an axis and opposite first and second ends, a first end rotatably mounted to the carriage, the second end of the elongated rod adapted to be grasped by a user, the first end of the elongated rod coupled to the spindle such that rotating the elongated rod causes a corresponding rotation of the spindle.

DETAILED DESCRIPTION OF THE INVENTION

Figure 1:
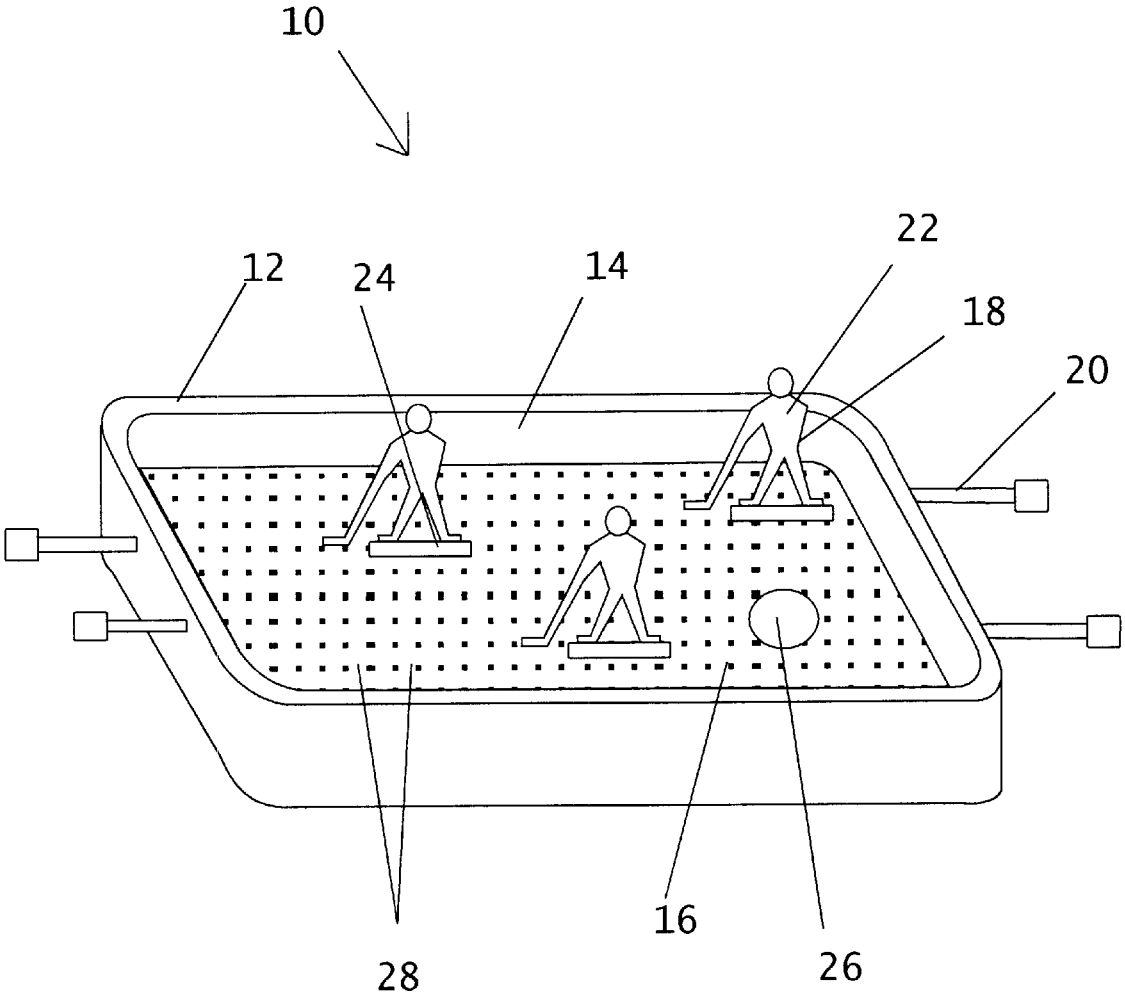
FIG. 1. is a perspective view, of the present invention.

Referring firstly to FIG. 1, a gaming board made in accordance with the present invention, shown generally as item 10, comprises game board 12 having sides 14, playing surface 16, lever arms 20 and gaming pieces 18. Gaming pieces 18 in turn comprise game FIG. 22 mounted on top of magnetic base 24. Lever arms 20 are mechanically coupled to gaming pieces 18 via base 24 such that a game player may manipulate puck 26 by moving lever arms 20. Playing surface 16 may be provided with perforations 28 to permit compressed air to flow through the board to support puck 26 on a cushion of air.

Figure 2:
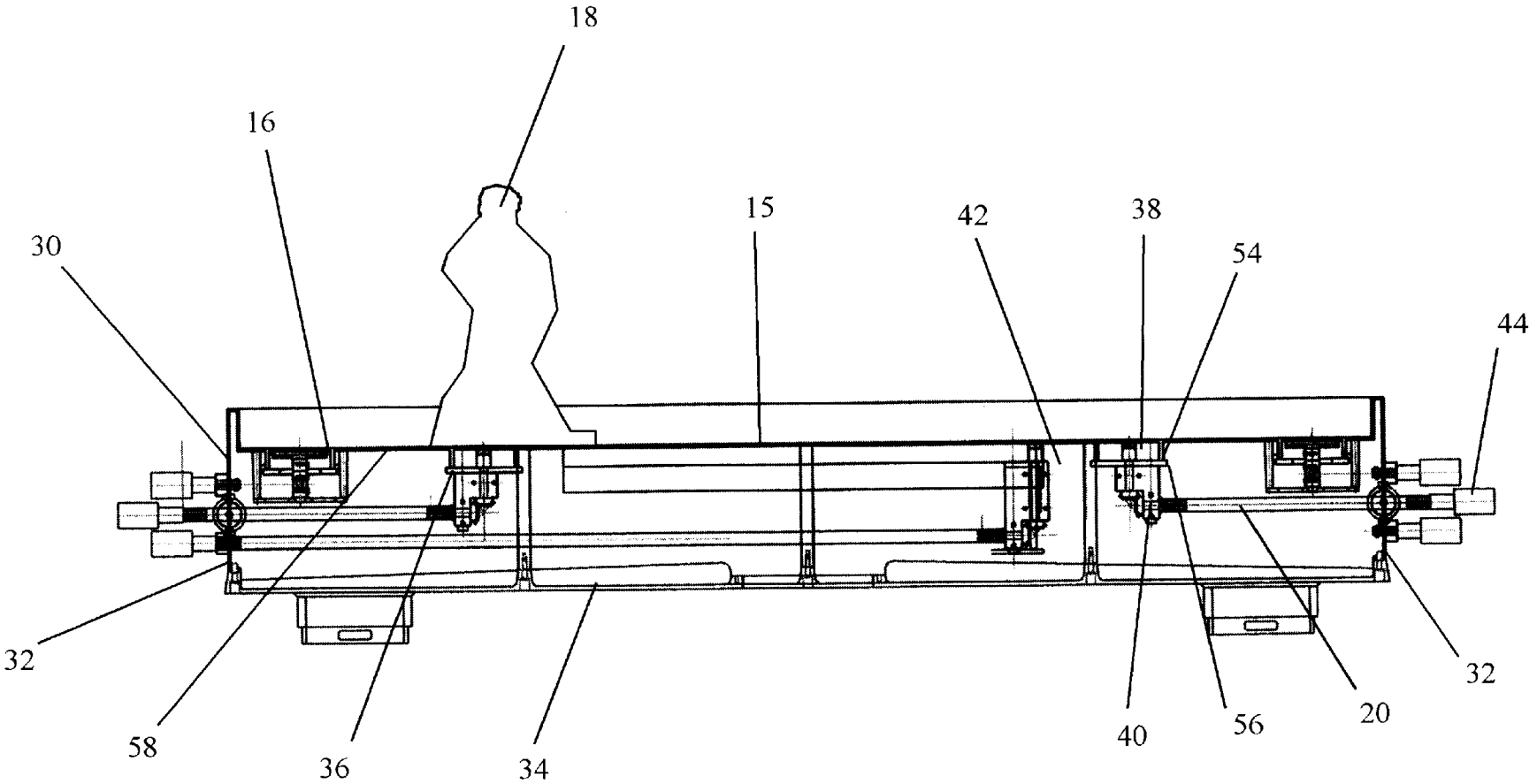
FIG. 2. is a cross sectional view of the rink portion of the present invention.

Referring now to FIG. 2, game board 12 comprises a housing 30 having side walls 32, bottom 34, player surface 16 and cavity 42. Suspended below player surface 16 within cavity 42 are a plurality of railed tracks 36 which support and guide carriages 38. Carriages 38 are in turn operatively coupled to lever arms 20 via gear mechanisms 40. Carriages 38 may be magnetically coupled to gaming pieces 18. Gear mechanisms 40 translate torsional forces on lever arms 20 into a spinning of gaming pieces 18. Lever arms 20 may be pushed or pulled into and out of cavity 42, which in turn causes carriages 38 to move along their respective tracks 36. Since carriages 38 may be Magnetically coupled to player pieces 18 the user can control the movement of the player pieces simply by pulling, pushing or twisting lever arms 20. Lever arms 20 are provided with end knobs 44 which make it easier for a player to manipulate the lever arms.

Figure 3:
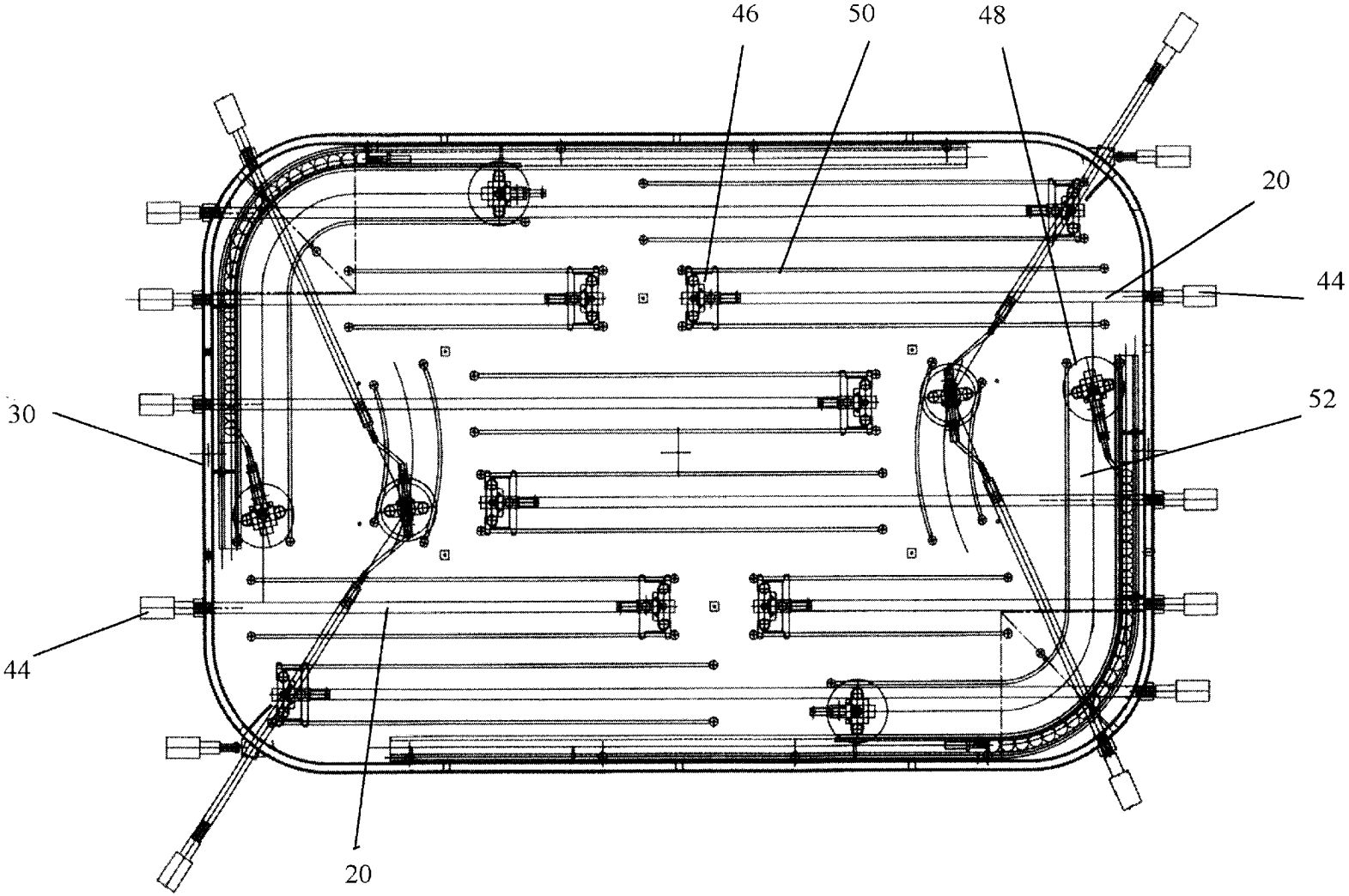
FIG. 3. is a bottom view of the rink portion of the present invention with the bottom portion of the housing removed and showing the carriages.

Referring now to FIG. 3, the present invention has two general types of carriages, namely straight track carriages 46 and curved track carriages 48. Straight track carriages 46 are mounted to straight tracks 50 such that carriages 46 may slide back and forth along the tracks (i.e. the carriages are slidingly mounted to the tracks). Curved track carriages 48 are slidingly mounted to curved tracks 52. Straight track carriages 46 can be moved back and forth along their respective tracks 50 by pushing or pulling on knobs 44 of lever arms 20. Likewise, curved track carriages 48 can be pushed and pulled back and forth along curved tracks 52 by pulling and pushing their respective lever arms 20.

Referring back to FIG. 2, each track consists of an upper pair of elongated rail members 54 and a lower pair of rail members 56. Carriage 38 is configured to be mounted between upper rail members 54 and lower rail members 56. Upper rail members 54 are preferably mounted to lower surface 58 or player surface 16. Player surface 16 preferably comprises the top surface of continuous flat sheet 15 made of molded plastic. Sheet 15 has lower surface 58 and downwardly protruding rail members 54. Lower rail members 56 preferably comprise elongated members which are mounted adjacent to and below rails members 54. Preferably, lower rail members 56 are mounted to lower surface 58 of sheet 15 just below upper rail members 54.

Figure 4:
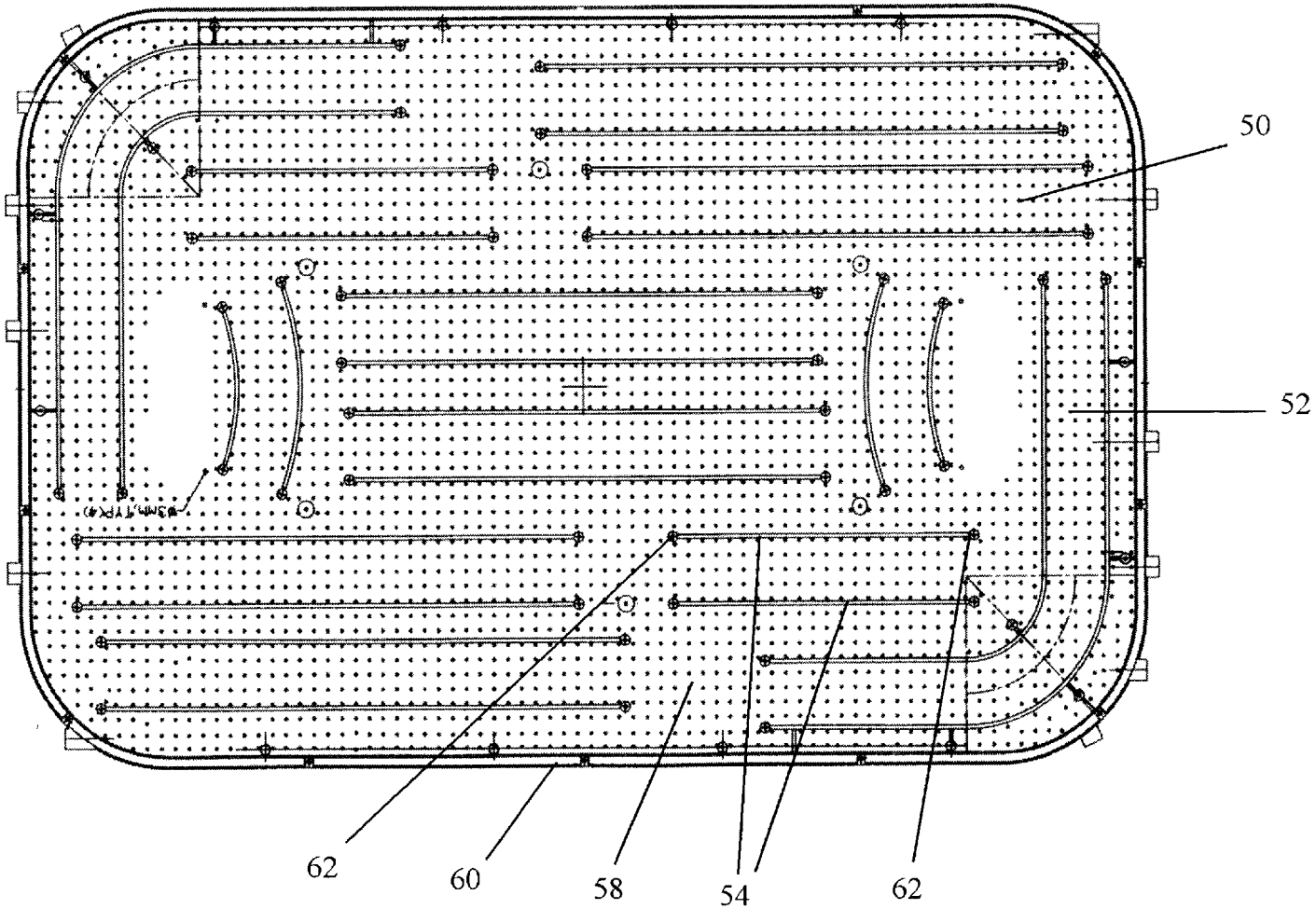
FIG. 4. is a bottom view of the playing surface portion of the rink portion of the present invention.

Referring now to FIG. 4, the underside 58 of sheet 15 has elongated rails 54 which form the upper halves of tracks 50 and 52. Rails 54 consist of elongated projections extending from surface 58 having terminal ends 62. Preferably, terminal ends 62 are configured to receive mounting screws (not shown) which enable the mounting of the lower rail members.

Figure 10:
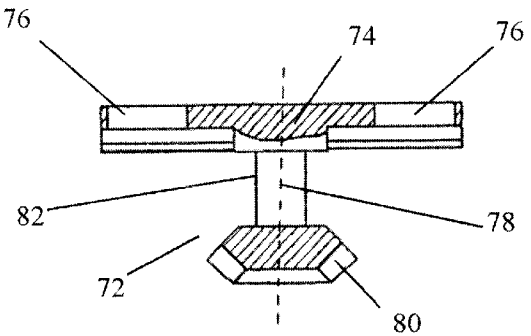
FIG. 10. is a side view, partly in cross section, of one of the spindle portions of the present invention.
Figure 7:
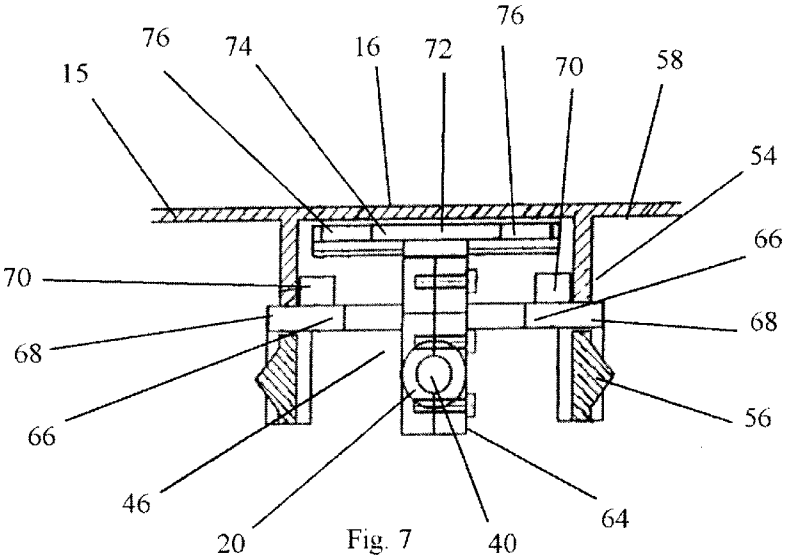
FIG. 7. is a cross sectional view of one of the carriage portions of the present invention.

Referring now to FIG. 7, carriage 46 comprises a housing 64 having wing portions 66. Wing portions 66 have tips 68 which are dimensioned and configured to fit between upper rail members 54 and lower rail members 56. Wing portions 66 also have studs 70 which are dimensioned to fit between upper rail members 54 and act as guides, keeping housing 64 precisely between rails 54. Housing 64 is adapted to securely retain spindle 72. Spindle 72 is rotatably mounted within housing 64 such that it can spin freely with little frictional resistance. Spindle 72 is operatively coupled to lever arm 20 via gear mechanism 40. Spindle 72 has elongated head portion 74 having magnets 76. Housing 64 is configured to suspend head portion 74 of spindle 72 just below surface 58 such that the head portion cannot make physical contact with surface 58. Referring now to FIG. 10, spindle 72 has head portion 74, gear 80, shaft 82, and vertical axis 78. Head 74 is configured to retain two rare earth magnets 76. Spindle 72 is made of a non-magnetic material such as plastic. Head 74 is sufficiently symmetrical such that spindle 72 can spin about its axis 78.

Figure 8:
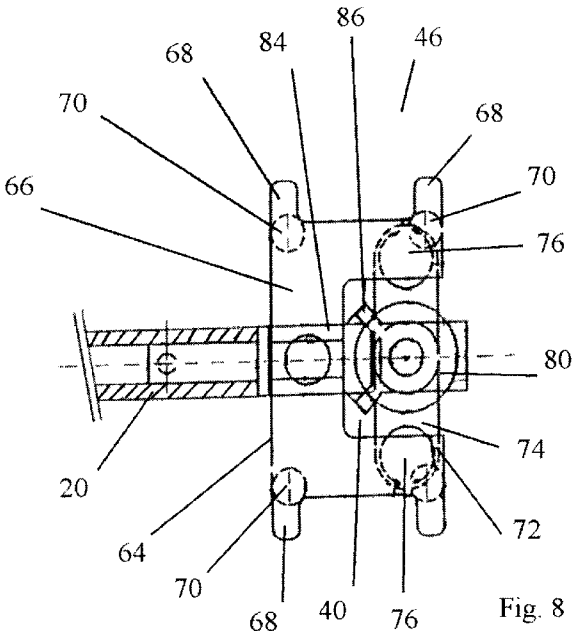
FIG. 8. is a top view of the carriage portion shown in FIG. 7.
Figure 9:
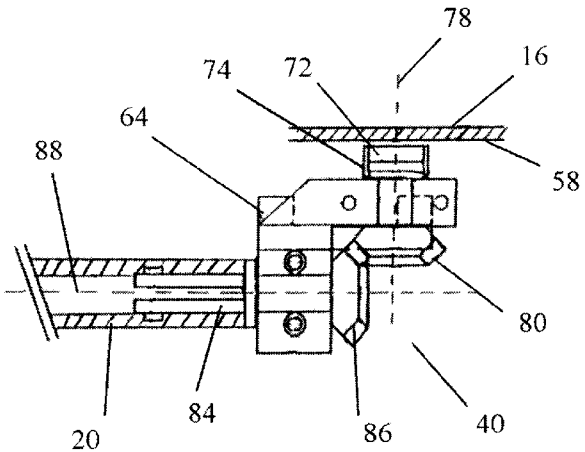
FIG. 9. is a side view, partly in cross section, of the carriage portion shown in FIG. 7.

Referring now to FIGS. 8 and 9, spindle 72 is mounted within housing 64 such that it can spin freely about axis 78. Spindle 72 is operatively coupled to lever arm 20 via gear mechanism 40. Gear mechanism 40 consists of a gear shaft member 84 having a gear 86. Gear 86 is adapted and configured to mesh with corresponding gear portion 80 of spindle 72 such that when shaft member 84 is rotated about its axis 88, gear 86 will cause gear portion 80 to rotate about axis 78. Shaft 84 is mechanically coupled to lever arm 20. Gear 86 and gear portion 80 act as a transmission, converting torsional forces in lever arm 20 into corresponding torsional forces on spindle 72. Since head portion 74 of spindle 72 is suspended just below surface 58 without making physical contact with the surface, spindle 72 can be spun freely with little frictional resistance.

Referring back to FIGS. 7 and 8, housing 64 is configured to permit carriage 46 to slide easily along rails 54 and 56. Housing 64 is preferably rectangular in, configuration and tips 68 and studs 70 are positioned towards the corners of housing 64 in order to guide the housing in as securely and smoothly as possible. Unfortunately, the rectangular configuration of housing 64, while quite adequate for straight track applications, is not suitable where the rail members define a curved track.

Figure 12:
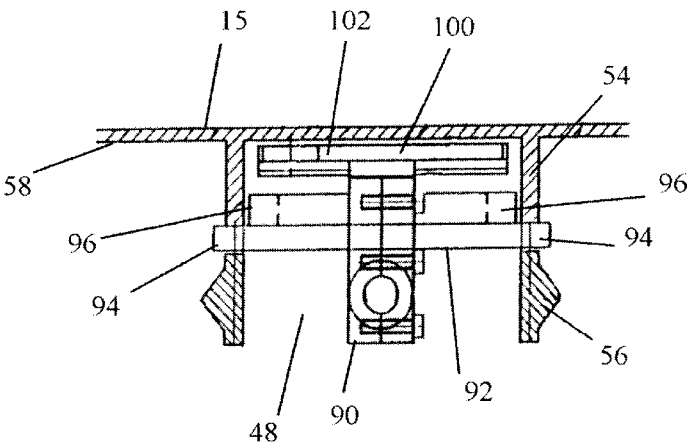
FIG. 12. is a cross sectional view of the carriage portion shown in FIG. 11.
Figure 13:
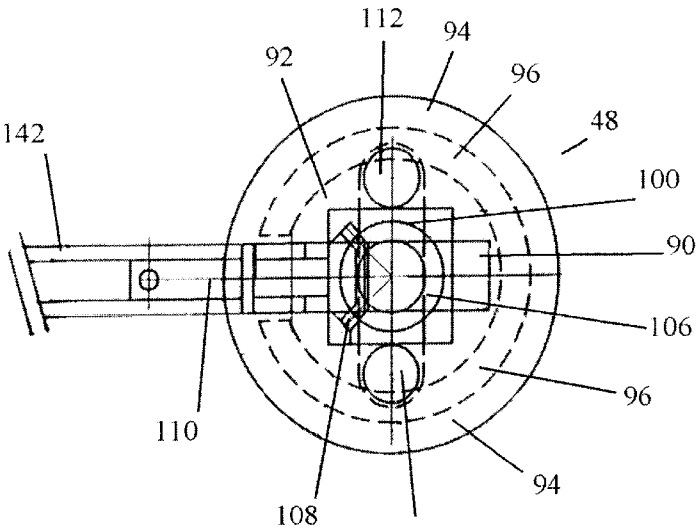
FIG. 13. is a top view of the carriage portion shown in FIG. 11.

Referring now to FIGS. 12 and 13, carriage 48 is specifically adapted to be used with rails which define a curved track. Carriage 48 consists of housing 90 having a flat semi-circular wing portions 92. Wing portions 92 have peripheral edges 94 which are dimensioned and configured to fit between rail members 54 and 56. Wing portions 92 also have ridges 96 which extends around the wing portions adjacent peripheral edges 94. Ridges 96 are dimensioned to fit snugly between upper rail members 54. Ridges 96 act as guides permitting carriage 48 to move back and forth along rail members 54 and 56 without jamming. Housing 90 is configured to hold spindle 100 such that head 102 is suspended immediately below surface 58 without making physical contact with the surface.

Figure 11:
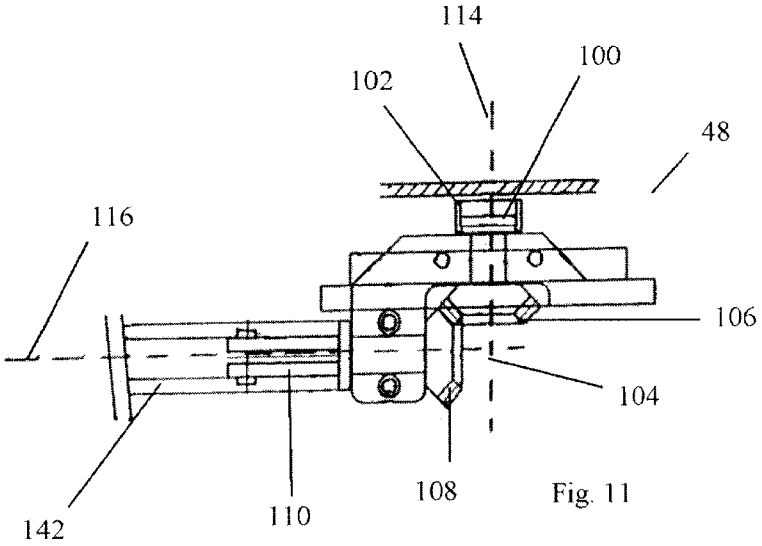
FIG. 11. is a side view partly in cross section, of another carriage portion of the present invention.

Referring now to FIGS. 11 and 13, spindle 100 is rotatably mounted within housing 90 such that the spindle may rotate freely with a minimum of friction. Spindle 100 is mechanically coupled to lever arm 20 via gear mechanism 104, which in turn consists of corresponding gears 106 and 108. Gear 106 forms part of spindle 100, while gear 108 is attached to flexible shaft 120 via shaft 1 10. Housing 90 is adapted to position gears 106 and 108 such that the two gears mesh and the gears are able to translate torsional forces between extension member 142 and spindle 100. Spindle head 102 also has rare earth magnets 112. Therefore, a user may cause magnets 112 in spindle head 102 to rotate about central axis 114 simply by causing extension member 142 to spin about its axis 116.

Figures 5, 6:
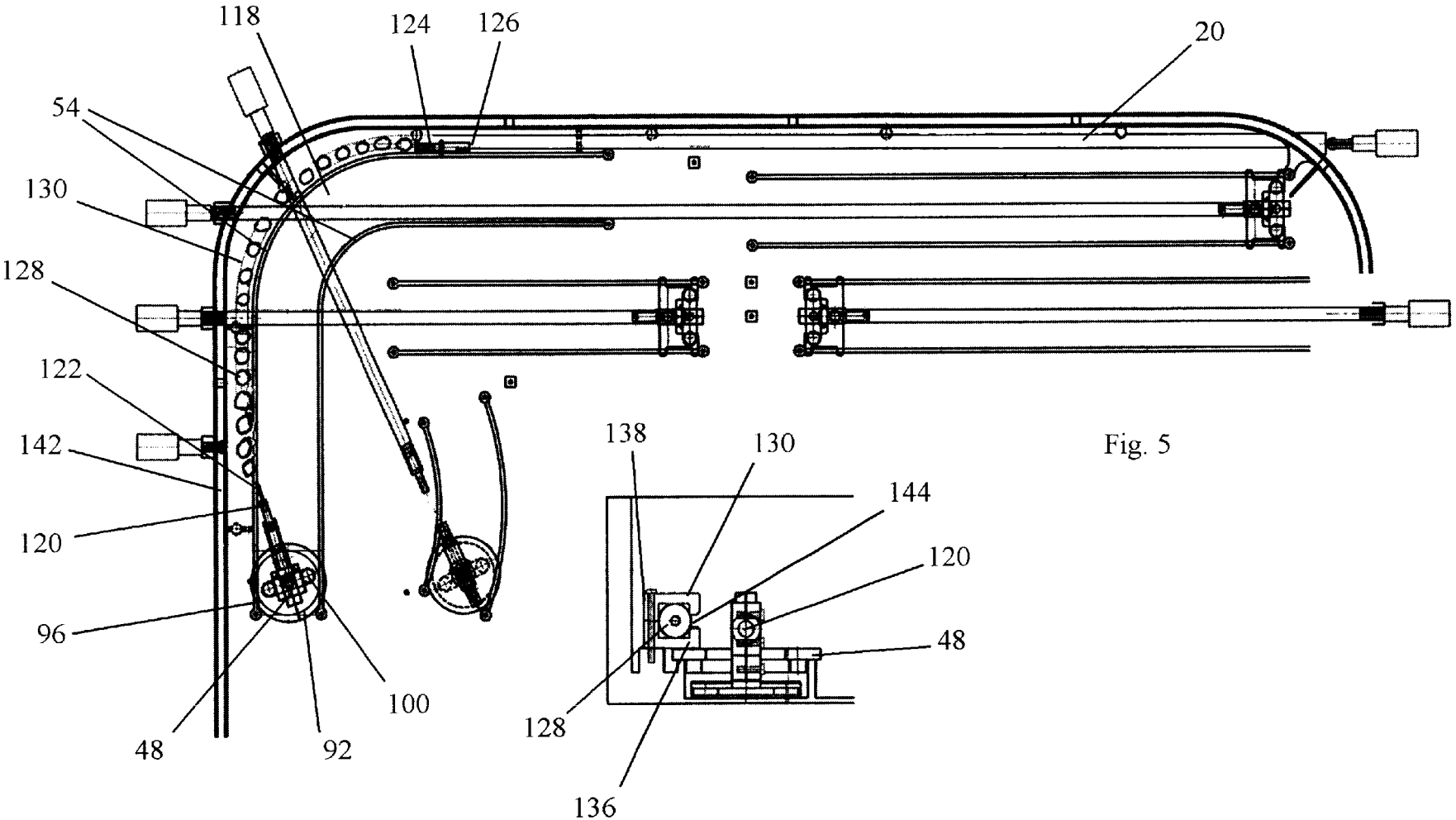
FIG. 5. is a bottom view of a corner section of the rink portion of the invention with the bottom portion of the housing removed.
FIG. 6. is a cross sectional view through line A—A of FIG. 5.

Referring now to FIG. 5, carriage 48 is configured to move along curved track 52. Curved track 52 is formed in part, from upper rail members 54. Carriage 48 has a circular wing member 92 which permits the carriage to move along curved track 52 without jamming. It has been discovered that as carriage 48 moves through bend 118 in curved track 52, ridge 96 keeps the carriage in proper alignment without jamming. Since ridge 96 is curved, it permits carriage 48 to navigate through bend 118 without losing contact with rail members 54.

As mentioned previously, spindle 100 is operatively coupled to extension member 142. Extension member 142 is in turn mounted to flexible shaft 120. Flexible shaft 120 consists of an elongated flexible torsion shaft having opposite ends 122 and 124. End 122 of flexible shaft 120 is coupled to carriage 48 via extension member 142, while end 124 of the flexible shaft is rigidly coupled to lever arm 20 via coupling 126. To ensure that flexible shaft 120 efficiently transfers torsional forces from lever arm 20 to spindle 100, the flexible shaft is passed through a series of hollow beads 128, which are in turn held in elongated channel 130.

Figure 16:
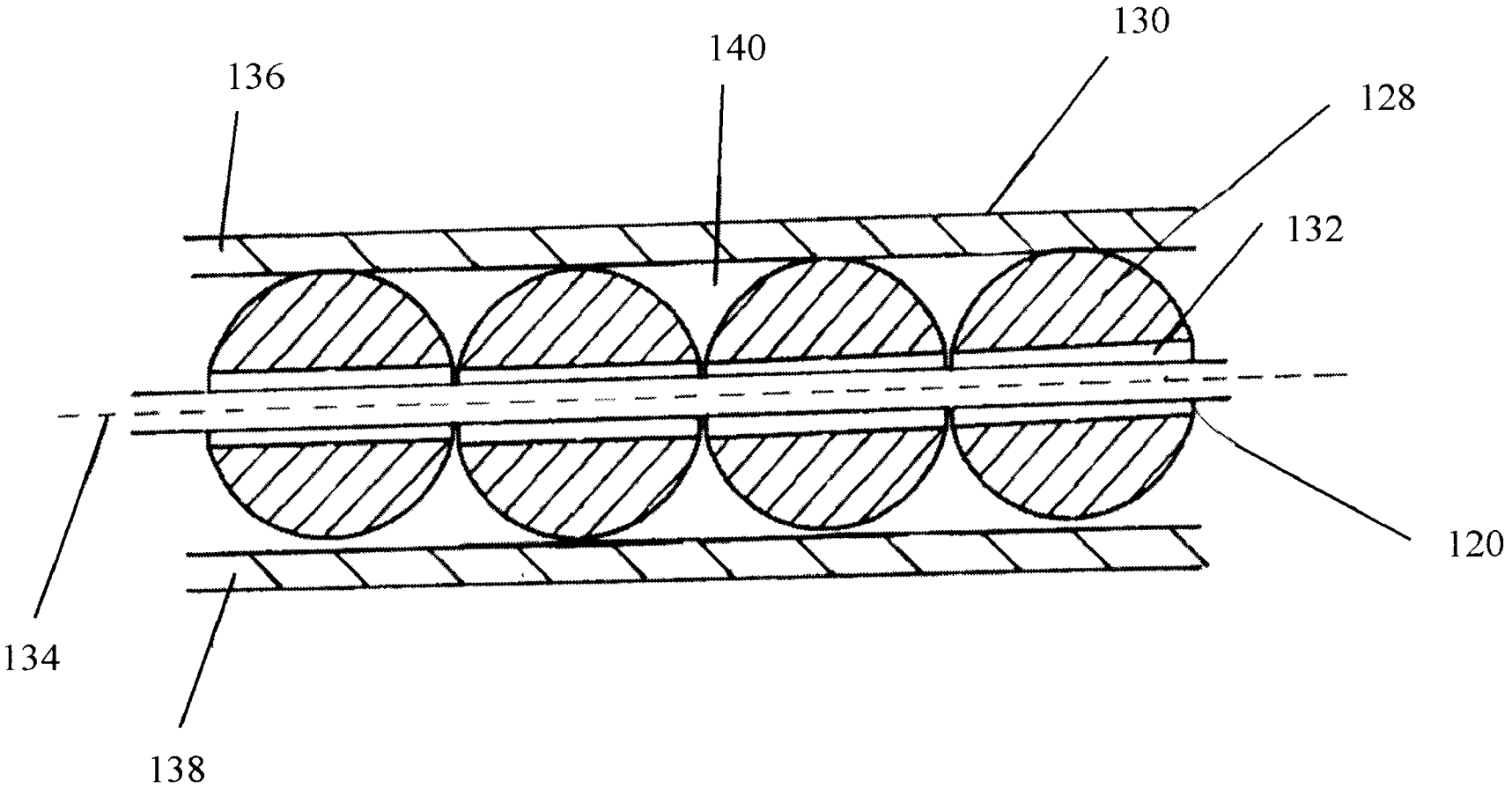
FIG. 16. is a long sectional view of the flexible torque transmission portion of the present invention.

Referring now to FIG. 16, beads 128 are individual beads made of a relatively low friction plastic material such as polyethylene, acrylic or Teflon. Beads 128 each have aperture 132 which is dimensioned to receive flexible shaft 120. The diameter of flexible shaft 120 and the inside diameter of aperture 132 is selected such that the flexible shaft may freely rotate about its longitudinal axis 134. Preferably, the inside diameter of aperture 132 is slightly greater than the outside diameter of flexible shaft 120. Individual beads 128 are oriented in abutting side to side orientation with their respective apertures 132 in co-axial alignment. This arrangement of co-axially aligned beads permits flexible shaft 120 to rotate freely. Beads 128 are retained in channel 130. Channel 130 consists of elongated members 136 and 138, which together define an internal passage 140 which is dimensioned to permit beads 132 to pass trough the passage. Preferably, the inside diameter of passage 140 is slightly greater than the outside diameter of beads 128, thereby permitting the beads to pass back and forth trough passage 140 with little difficulty. Preferably, elongated members 136 and 138 are also made of a low friction plastic material such as polyethylene, PVC or Teflon, thereby permitting the beads to pass back and forth through channel 130 with a minimum of difficulty. Beads 128 position flexible shaft 120 in the center of channel 140 regardless of how the beads are moved. By keeping flexible shaft 120 in the center of channel 140 even as beads 128 are moved back and forth through channel 130, the flexible shaft is positioned to rotate relative to longitudinal axis 134 with a minimum of difficulty.

Referring back to FIG. 5, beads 128 are threaded onto flexible shaft 120 and held in place by extension member 142 positioned at end 122 of flexible shaft 120, and coupling 126 positioned at end 124 of the flexible shaft. Extension member 142 and coupling 126 are dimensioned to retain beads 128 between them. Since beads 128 are held between extension member 142 and coupling 126, the beads can be moved back and forth along channel 130 simply by pushing or pulling on lever arm 20. Since beads 128 position flexible shaft 120 towards the center of channel 130, the flexible shaft can efficiently transfer torsional forces from lever arm 20 to spindle 100. Extension member 142 is a long rigid shaft which couples flexible shaft 120 to carriage 48.

Referring now to FIG. 6, channel 130 has an elongated opening 144 which is dimensioned to permit extension member 142 to pass there through and make contact with carriage 48. Elongated opening 144 permits extension member 142 travel along channel 130 while remaining coupled to carriage 48.

Figure 14:
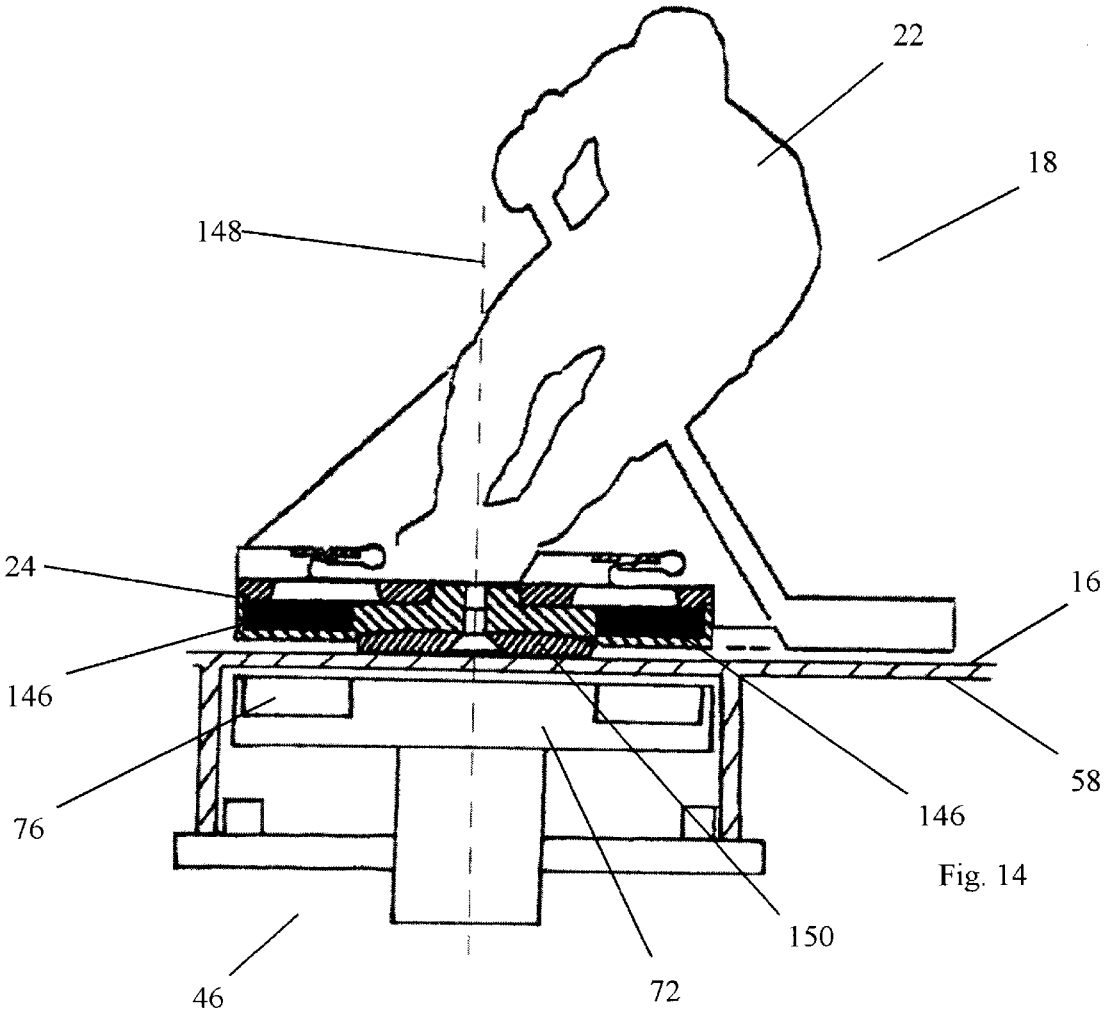
FIG. 14. is a side view, partly in cross section, of one of the player pieces of the present invention.

Referring now to FIG. 14, gaming piece 18 consists of figurine 22 mounted to magnetic base 24. Magnetic base 24 consists of an elongated member which holds rare earth magnets 146. Base 24 also has platform 150 which is dimensioned and configured to support base 24 and keep magnets 146 out of physical contact with playing surface 16. Carriage 46 suspends spindle just below surface 58 such that magnets 76 are maintained in close proximity to surface 58 without actually making physical contact with surface 58. Platform 150 is preferably no more than a few millimeters thick in order to place magnets 146 in close proximity to magnets 76 such that the magnetic flux between the two sets of magnets is sufficiently strong to keep base 24 magnetically coupled to spindle 72. Platform 150 is preferably made of a low friction plastic material such as Teflon, thereby permitting base 24 to slide easily across surface 16. Platform 150 also acts as a low friction bearing permitting base 24 to rotate easily around axis 148. To minimize the frictional forces on platform 150, the platform is preferably round or annular in shape and has a minimum amount of surface area in contact with surface 16. Furthermore, by placing platform 150 between magnets 146, the diameter and surface area of platform 150 can be minimized without greatly effecting the stability of base 24.

Figure 15:
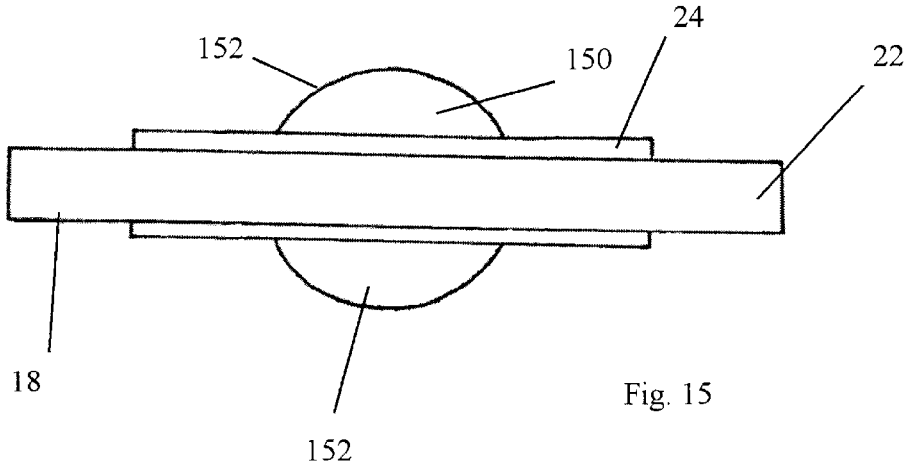
FIG. 15. is a top view of one of the player pieces of the present invention.

Referring now to FIG. 15, the key to maintaining a stable free standing gaming piece 18 which also permits easy rotation of the gaming piece about axis 148 is the ratio of the diameter of platform 150 to the diameter of base 24. If the diameter of base 150 is too large relative to base 24, then the frictional forces resisting rotation of base 24 will be too high. However, if the diameter of platform 150 is too small relative to base 24, then piece 18 will be too unstable and fall over too frequently to be practical. It has been discovered that if the diameter of platform 150 is approximately 50% of the diameter of base 24, then the platform will provide the ideal combination of stability and ease of rotation.

Referring now to FIGS. 14 and 15, making platform 150 circular has the added advantage of making gaming piece 18 more versatile. Platform 150 has sides 152 which project to either side of base 24, preventing player piece 18 from lying flat on its side. If player piece 18 is inadvertently knocked down on its side, then sides 152 of platform 150 prevent the player piece from lying flat on its side. If carriage 146 is then positioned immediately below the fallen piece, and spindle 72 is rotated the magnetic forces acting on base 24 will urge the base towards the spindle. As base 24 is magnetically urged towards spinning spindle 72, projecting sides 152 of platform 150 act as fulcrums permitting player piece 18 to be stood upright. Therefore, a user can reposition player piece 18 without having to touch the gaming piece. This adds novelty to game play, and creates a more convincing representation of real life sporting events, wherein players routinely fall down and then pick themselves up.

Specific embodiments of the present invention have been disclosed; however, several variations of the disclosed embodiments could be envisioned as within the scope of this invention. It is to be understood that the present invention is not limited to the embodiments described above, but encompasses any and all embodiments within the scope of the following claims.

What is claimed is:

1. A device for movably coupling a gaming piece to a substantially non-magnetic surface having opposite first and second sides, said device comprising;

(a) a base mountable to the gaming piece, the base comprising a housing, a first and second magnet and a first support element positioned between the first and second magnets, the first support element dimensioned and configured to support the base on the first side of the surface, (b) a magnetic coupling positioned on the second side of the surface, said magnetic coupling comprising a spindle member having an axis and a first and second magnet, the spindle member being rotatably mounted in a carriage housing such that the spindle can rotate relative to its axis, the carriage housing being adapted and configured to position the magnets of the spindle in close proximity to the second side of the surface without making contact with said surface, (c) the support element of the base and the carriage housing of the magnetic coupling configured to position the magnets of the base in close proximity to the magnets of the magnetic coupling when the base and magnetic coupling are positioned across each other on opposite sides of the surface, (d) an elongated rod having an axis and opposite first and second ends, a first end rotatably mounted to the carriage housing, the second end of the elongated rod adapted to be grasped by a user, the first end of the elongated rod coupled to the spindle such that rotating the elongated rod causes a corresponding rotation of the spindle.

2. A device as defined claim 1 wherein the support element comprises a substantially circular disk of low friction material.

3. A device as defined in claim 1 wherein the first and second magnets of the base are separated by a distance and wherein the support element comprises a substantially circular disc of low friction material, the disc having a diameter less than the distance separating the magnets of the base.

4. A device as defined in claim 3 wherein the support member has a diameter and wherein the diameter of the support member is approximately one half of the diameter of the base.

5. A device as defined in claim 1 wherein the carriage housing is mounted to a track, the track comprising a first pair of elongated rail, the first pair of rails extending from the second surface.

6. A device as defined in claim 5 wherein the carriage housing comprises projecting side portions, the side portions being movably mounted to the first pair of elongated rails such that the carriage can move along the rails.

7. A device as defined in claim 6 wherein the side portions of the carriage housing have projecting studs, the studs positioned on the side portions adjacent to the rails such that the studs limit any lateral movement of the carriage relative to the rails.

8. A device as defined in claim 6 wherein the track further comprises a second pair of elongated rails positioned adjacent to and below the first pair of elongated rails, the side portions of the carriage housing dimensioned and configured to fit between the first and second pair of rails.

9. A device as defined in claim 5 wherein the track further comprises a second pair of elongated rails positioned adjacent to and below the first pair of elongated rails and wherein the carriage housing has a substantially circularly shaped member having a peripheral edge, the peripheral edge adapted and configured to fit between the first and second pair of rails, the circular member having a substantially circular hub positioned adjacent the peripheral edge, the circular hub dimensioned to limit the lateral movement of the carriage housing relative to the rails.

10. A device as defined in claim 1 wherein the spindle has a head portion and a tail portion, the head portion housing the magnets and the tail portion forming a gear, the magnets positioned on either side of the spindle's axis, the first end of the lever member being operatively coupled to the gear portion of the spindle.

11. A device as defined in claim 10 wherein the first end of the elongated rod forms a gear, the gear of the lever member adapted and configured to mesh with the gear portion of the spindle.

12. A device as defined in claim 1 wherein the elongated rod has a flexible portion positioned between the first and second ends, the flexible portion adapted and configured to bend, the flexible portion being further adapted and configured to transfer torsional forces from the first end of the rod to the second end of the rod while the flexible portion is bent.

13. A device as defined in claim 12 wherein the flexible portion of the rod is housed in a curved conduit, the conduit having an internal passage dimensioned to permit the flexible portion to pass through the passage.

14. A device as defined in claim 13 wherein the flexible portion of the rod is further contained within a plurality of beads, the beads each having an aperture dimensioned to receive the flexible portion of the rod, the aperture further dimensioned to permit the flexible portion of the rod to rotate about its axis, the beads having an outside diameter, the outside diameter of the beads dimensioned to permit the beads to pass through the passageway.

15. A device as defined in claim 14 wherein the conduit has an elongated slot, the elongated slot dimensioned to permit the first end of the rod to pass though the slot and make contact with the carriage housing.

16. A device as defined in claim 15 wherein the rod further comprises a connecting member mounted to the first end of the rod, the connecting member having a proximal end adjacent the flexible shaft and a distal end rotatably mounted to the carriage, the distal end being coupled to the spindle, the distal end of the connecting member configured to prevent the beads from dislodging from the flexible shaft, the connecting member being further dimensioned to pass through the slot.

17. A device as defined in claim 16 wherein the spindle has a head portion and a tail portion, the head portion housing the magnets, the tail portion configured to form a first gear, and wherein the proximal end of the connecting member is configured to form a second gear, the first and second gear configured to mesh together.

18. A device as defined in claim 14 wherein the beads are in abutting coaxial alignment.

* * * * *